US009186882B2

(12) United States Patent
Felix et al.

(10) Patent No.: US 9,186,882 B2
(45) Date of Patent: Nov. 17, 2015

(54) PRINTING FINISHING SYSTEM AND METHOD FOR OPERATING A PRINT FINISHING SYSTEM

(75) Inventors: Markus Felix, Richterswil (CH); Martin Ruge, Starrkirch-Wil (CH)

(73) Assignee: Ferag AG, Hinwil (CH)

( * ) Notice: Subject to any disclaimer, the term of this patent is extended or adjusted under 35 U.S.C. 154(b) by 181 days.

(21) Appl. No.: 13/699,536

(22) PCT Filed: May 4, 2011

(86) PCT No.: PCT/EP2011/057141

§ 371 (c)(1),
(2), (4) Date: Dec. 18, 2012

(87) PCT Pub. No.: WO2011/144451

PCT Pub. Date: Nov. 24, 2011

(65) Prior Publication Data

US 2013/0209151 A1 Aug. 15, 2013

(30) Foreign Application Priority Data

May 21, 2010 (CH) ..... 0805/10

(51) Int. Cl.
*B65H 29/58* (2006.01)
*B41F 23/08* (2006.01)
*B65H 39/02* (2006.01)

(52) U.S. Cl.
CPC ..... *B41F 23/08* (2013.01); *B65H 29/58* (2013.01); *B65H 39/02* (2013.01); *B65H 2301/14* (2013.01); *B65H 2301/435* (2013.01); *B65H 2301/438* (2013.01); *B65H 2301/4311* (2013.01); *B65H 2301/4322* (2013.01)

(58) Field of Classification Search
CPC ..... B65H 29/58; B65H 39/02
USPC ..... 270/52.14, 52.16, 52.19, 52.26, 52.29, 270/52.3
See application file for complete search history.

(56) References Cited

U.S. PATENT DOCUMENTS 3,241,039 A 3/1966 Wilting
5,562,278 A * 10/1996 Muller et al. ..... 270/58.21
5,706,632 A 1/1998 Kivits et al.
5,732,939 A 3/1998 Meier (Continued)

FOREIGN PATENT DOCUMENTS

CH 466 866 2/1969
CH 649 063 A5 4/1985

(Continued)

*Primary Examiner* — Patrick Mackey
(74) *Attorney, Agent, or Firm* — Pauley Erickson & Kottis

(57) ABSTRACT

A device and method for producing complex multipart collections (K1) of printed products includes at least two partial collections (T1, T2, T3) of precursors. The device comprises a collating device (6) having a conveyor track (41) on which a plurality of receptacle units (50) circulate in a closed circuit for receiving collated precursors, and on which a plurality of feeder apparatuses (101-112) are disposed in at least one collating region (11, 12), from which precursors are dispensed into the receptacle units (50) moving past on the conveyor track. A transfer apparatus (30) is disposed in at least one location of the conveyor track (42), transferring collated first partial collections (T1) from the receptacle units (50) for further processing, and a collator (31, 32) is disposed in at least one further location of the conveyor track (41, 43), collating further collated partial collections (T3, T4) from the receptacle units (50) into collections (K1).

20 Claims, 5 Drawing Sheets

(56) References Cited

U.S. PATENT DOCUMENTS

| | | | | |
|---|---|---|---|---|
| 5,791,641 | A * | 8/1998 | Muller | 270/52.16 |
| 6,304,795 | B1 | 10/2001 | Reist | |
| 6,612,559 | B2 * | 9/2003 | Boss | 270/52.18 |
| 7,055,814 | B1 * | 6/2006 | Boss | 270/52.29 |
| 7,845,485 | B2 | 12/2010 | Honegger | |
| 7,959,144 | B2 * | 6/2011 | Ramseier | 270/52.3 |
| 8,424,861 | B2 * | 4/2013 | Buchel | 270/52.3 |
| 8,733,752 | B2 * | 5/2014 | Heiniger | 270/52.19 |
| 2004/0089991 | A1 * | 5/2004 | Stauber | 270/52.3 |
| 2004/0239076 | A1 * | 12/2004 | McCoy et al. | 280/495 |
| 2006/0071407 | A1 | 4/2006 | Graushar et al. | |
| 2006/0231998 | A1 * | 10/2006 | Maeder | 270/52.14 |
| 2010/0237553 | A1 * | 9/2010 | Buchel | 270/58.08 |

FOREIGN PATENT DOCUMENTS

| | | | |
|---|---|---|---|
| DE | 547 279 | | 3/1932 |
| DE | 195 24 912 | A1 | 2/1996 |
| DE | 197 30 419 | B4 | 2/1998 |
| EP | 0 344 102 | A2 | 11/1989 |
| EP | 0 672 603 | A1 | 9/1995 |
| EP | 0 681 979 | A1 | 11/1995 |
| EP | 0 716 037 | A1 | 6/1996 |
| EP | 2 107 023 | A1 | 10/2009 |
| WO | WO 02/057164 | A1 | 7/2002 |
| WO | WO 2009/049438 | A1 | 4/2009 |
| WO | WO 2010/051651 | A2 | 5/2010 |

* cited by examiner

P
58
60
52
1
57
56
51
50
53
30
42
T1
V
113
114
V
101
102
103
104
105
106
107
108
109
110
111
112
HP
90
70
5
10
50
T2
31
HP + T1
36
55
K
40
54

P'
2
57
56
60
51
42
30
$T_1$
50
HP
52
53
54
59
32
41
$T_3$
12
101
102
103
104
105
106
107
108
109
110
111
112
11
6
70
71
55
K1
$T_4$
43
31
$T_3 + (HP + T_1)$
36
40

PRINTING FINISHING SYSTEM AND METHOD FOR OPERATING A PRINT FINISHING SYSTEM

BACKGROUND OF THE INVENTION

1. Field of the Invention

The present invention refers to the area of print finishing. It relates to a print finishing system as claimed in the preamble of claim 1. The present invention also relates to a method for operating such a print finishing system.

2. Discussion of Related Art

In modern printing operations, during the further processing of printed products which originate from rotary presses, high processing speeds and capacities are demanded. In addition, there is the desire for the most efficient use and full capacity utilization of the systems, this above all also in view of the relatively high investment costs of the printing press and conveying systems. At the same time, the further processing is also to enable a high level of flexibility so that as many end formats of pre-products, main products and/or part products as possible can be processed further by means of the same system. The conventional conveying and processing systems in printing operations are still based, in this case, on serial processing concepts. In this case, printed products or part products, etc. are transported in the majority of cases by means of conveying belts, feeders or the like on a conveying line, often as a shingle stream, and are supplied to processing systems. As rotary presses according to their operating principle generally print paper webs in a serial manner, processing the printed products further in a serial manner is obvious. A serial processing concept is also often imposed as a result of the operating steps during further processing requiring a serial sequence. Accordingly, up to now conventional conveying and processing systems have remained restrained by said serial principle.

To increase the processing capacity, it has been proposed many times during further print processing to divide the printed product stream into several part streams by means of points. Such an apparatus is described, for example, in Patent Application CH 04 668/86. By using buffer devices, one or more continuous streams of printed products are divided into supply sections of at least two processing stations. Another method as claimed in Patent CH 649 063 shows how a conveying track is divided into several tracks in order "to be able to use the known and proven conveying technology". This is meant to achieve the object of maintaining the output of the suppliers, called feeders in the document, whilst retaining the mentioned conveying technology. The required processing capacity is divided into several transporting or processing paths which, for their part, once again use a purely serial conveying method. The disadvantage of dividing the conveying tracks is that along with a large space requirement for the separate lines, each of said lines requires its own processing means, etc. Consequently, expenditure on machines and organization is actually duplicated.

In the production of complex products where, if need be, parts of the products are also sewn, bonded, trimmed, coated, addressed, provided with stick-on labels or processed in another way, up to now in a corresponding manner many collating apparatuses have had to be set up and operated. This meant a large amount of expenditure on apparatuses and resulted in a correspondingly increased requirement for space.

An example of a device for processing printed products which is suitable for the production of complex, multi-part printed products is known from EP 0681979. Printed products are collected using at least one collecting drum. For carrying out certain processing steps on the printed products or for adding additional products to the printed products, said printed products are guided out of the collecting drum into a whirling arm. The printed products, in this case, retain their state in an unchanged manner when transferring from the processing drum to the whirling arm and from the whirling arm to the processing drum. They consequently do not "note" whether they are situated in the processing drum or in the whirling arm. As the whirling arm can be guided along a practically arbitrary movement path, there is the possibility for the most varied processing steps. The whirling arm offers, in particular, the possibility of guiding the printed products away from the processing drum for the execution of special processing steps or the supplying of additional products and of returning them again to said processing drum for further processing. As a further particular advantage, EP 0681979 provides that the whirling arm enables the transferring of the printed products from one processing drum to another, during the transfer the processing of the printed products or the supplying of additional products being made possible. In addition, the present invention makes possible the carrying out of special processing steps or the addition of additional products in the supply to the processing drum or in the guiding away from the processing drum, the serial processing mode always being retained, that is to say all the printed products in the product stream inside and outside the drum run through the same conveying belt and consequently the same processing steps and are processed strictly in a serial manner. This is so even in the case of embodiments where the printed products are guided from the drum to the whirling arm and back to the processing drum.

SUMMARY OF THE INVENTION

It is, consequently, an object of the invention to create a print finishing system which avoids the disadvantages of the known collating apparatuses and enables a flexible operation and the production of complex products with reduced expenditure on machines and a reduced requirement for space.

It is a further object of the invention to create a method for the collating and further processing of flat pre-products, in particular for producing complex product collections, said method only requiring a minimum of processing apparatuses, but utilizing them in an optimum manner.

These objects are achieved through a print finishing system with the features of the characterizing part of claim 1 and a method for the collating and further processing of flat pre-products with the features of claim 6.

It is important to the invention that in a collating apparatus of a print finishing system receiving units are conveyed along a conveying track by means of a spatially flexible, preferably chain-like, closed per se conveying member and that a transfer device, which takes on and removes collated part collections from the receiving units for further processing, is arranged at least at one position on the conveying track, and that a merging feed, which merges further part collections from the receiving units with the first part collections or with printed products that include the first part collection, is arranged at least at one further position on the conveying belt.

Within the framework of the present application, a difference is made between transfer devices and merging feeds. Transfer devices refer to all devices by means of which the part collections which are collated in the collating apparatus are output from said collating apparatus and are transferred for further treatment and/or processing. The transfer devices as claimed in the invention can include all types of devices and elements for outputting, guiding, receiving, conveying and transporting part collections of flat printed products, in particular also regions of the collating apparatus. Using a transfer device as claimed in the present invention, part collections can be transferred singly or in the shingle stream, however, no part collections can be merged to form collections. The term merging refers in the present application to a first collection from the collating apparatus being joined to at least one second collection from the same collating apparatus to form a collection and being further processed together or at least further treated, conveyed or transported.

As claimed in preferred embodiments, the merging feeds as claimed in the invention include in each case at least one transfer device by way of which a part collection is output from the collating apparatus. The merging can be managed directly by the transfer device, but further apparatuses, systems or parts can also participate therein. The decisive factor is that a first part collection originating from the collating apparatus and a second part collection also originating from the collating apparatus are always merged in the merging feed. In the present application, any devices which serve for outputting or transferring part collections from conveying devices, which are not included in the collating apparatus, to the merging feed are referred to as an output device. Not only part collections but also printed products which include part collections can be transferred in the output devices. Common to all output devices is that at least one transfer device is connected in series upstream of them in the conveying direction.

Through the special development of the collating apparatus, the receiving units, the transfer devices and in particular the merging feeds, it is possible using the same collating apparatus, with no additional expenditure, to process further different part collections from collated products, such as, for example, magazines, newspapers, newspaper parts, signatures, part products and pre-products, supplements, cards, CDs or the like (referred to below as pre-products) in different ways and/or in different lines and subsequently to merge them again with further part collections from the collating apparatus and in this way to produce complex product collections.

The print finishing systems as claimed in the invention for the collating and further processing of flat pre-products include a collating apparatus with a conveying track, on which in closed circuit, a plurality of receiving units, which are arranged one behind the other in the direction of circulation, circulate for receiving collated pre-products. In at least one collating region, which the receiving units run through, several supplying devices are arranged one behind the other in the direction of circulation, from which supplying devices pre-products are output into the receiving units moving past them on the conveying belt. The receiving units are preferably conveyed on a conveying track by means of a spatially flexible, preferably chain-like, closed per se conveying element and the receiving units have in each case clamping means which hold the pre-products collated in the receiving units, that is to say at least one pre-product, in a clamping manner.

A transfer device, which controls collated first part collections in a known manner from the receiving units of the collating apparatus and transfers them for further processing in a further processing line connected downstream whilst retaining the relative position of the pre-products as precisely as possible with respect to each other in the collated part collection, is arranged at least at one position on the conveying track. A merging feed, by means of which collated further part collections from the receiving units are merged with the first part collections or with printed products that include the first part collection to form collections, is arranged at least at one further position on the conveying track.

Neither transfer devices nor merging feeds are to be confused with a waste paper ejector, as is known for the Applicant's "Flystream" type collating apparatuses. In this case, just incomplete and surplus product collections are discarded or ejected in another manner and are preferably collected in a collecting container. The waste paper copies have to be disposed of or sorted out by hand and supplied again manually for processing. A corresponding waste paper ejector is preferably also provided in the case of the systems as claimed in the invention.

One embodiment of the print finishing system as claimed in the invention is characterized in that at least one further transfer device is arranged at least at one further position on the conveying belt of the collating apparatus and/or that at least one further merging feed is arranged at least at one further position of the conveying belt.

A further embodiment is characterized in that there is provided a control means which, in a predetermined manner, controls the supplying devices, the transfer device or the transfer devices and the merging feed in such a manner that in each case the desired part collections or printed products that include the desired part collections are available at the merging feed or the merging feeds.

The supplying devices, the transfer device or the transfer devices and the merging feed are preferably controlled by the control means in a predetermined manner in such a manner that part collections from the receiving units can be merged with the first part collections or with printed products that include the first part collections in the at least one merging feed to form collections according to a higher-ranking production plan.

As claimed in a further advantageous embodiment, by means of the control means the pre-products of a certain supplying device or of a group of supplying devices are allocatable to a certain transfer device or a certain merging feed and are suppliable to certain further processing by means of the same.

One embodiment of the invention is characterized in that the conveying track includes an upper track section or run and a lower track section or run which extend essentially parallel and are connected together at the ends by guide regions and form a closed circuit. At least one collating region is preferably provided at the upper track section and at the bottom track section and/or at the guide regions several transfer devices and/or merging feeds are arranged. The collating regions are distinguished in that pre-products and/or supplements are supplied therein to the receiving units by means of at least one supplying device. A plurality of supplying devices are preferably arranged in a space-saving manner on both sides of the conveying track in each collating region.

A further development of the invention is characterized in that several collating regions are arranged one behind the other in the direction of circulation on the conveying track. As the receiving units are conveyed by means of a spatially flexible, preferably chain-like conveyor element, the conveying track can be designed between consecutive collating regions to form an intermediate loop and the one transfer device or a merging feed can be arranged at the intermediate loop.

As claimed in preferred embodiments, a preferably linear portion of a conveying track is rotated about its longitudinal axis such that the receiving units are conveyed in a linear manner when running through said sections and at the same time are pivoted in radial manner. Without a collating apparatus having an upper run and a lower run, in this way the receiving units can be provided from above with pre-products or supplements in a collating region, the collated part collections can then be moved downward by pivoting the receiving units about 180° into a spatial alignment preferred for outputting, can be output in a transfer device or a merging feed and by means of renewed pivoting once again about 180° products can be supplied once again from above in a further collating region. The functionality of the upper and lower run is realized by the pivoting in a region of the apparatus which is aligned essentially in a linear manner.

The method as claimed in the invention for the collating and further processing of flat pre-products, which is preferably carried out using one of the aforementioned systems, includes the following steps:

- collating a first part collection of pre-products from a certain supplying device or a group of supplying devices in at least one first receiving unit;
- collating a further part collection of pre-products from a certain supplying device or a group of supplying devices in at least one subsequent receiving unit;
- transferring the first part collection of pre-products by means of a certain transfer device and consequently to certain further processing;
- transferring the further part collection of pre-products by means of a certain further transfer device; and
- collating the first part collection or a printed product produced by using the first part collection and the further part collection to form a collection.

The term subsequent receiving unit can refer in the present application either to a spatially subsequent, further receiving unit which follows a first receiving unit in the collating apparatus in the conveying direction. The term subsequent, however, in the sense of subsequently in time, can also refer to the same receiving unit which, after receiving and outputting a first part collection, receives a second or further part collection at a later point in time. The merging of two or more part collections can include, as claimed in the present invention, the following steps: stacking in layers which can also be partially or laterally offset, placing side by side, insertion next to each other or insertion into each other, a detachable or non-detachable connection, as well as all combinations of the aforesaid.

One embodiment of the method as claimed in the invention is characterized in that in at least one further merging step at least one further part collection or one further printed product produced by using the further part collection is added to form a collection.

At least one further part collection from the collating apparatus is preferably supplied to further processing in at least one further transfer step.

In the case of print finishing systems as claimed in the invention where the collating apparatuses have at least two consecutive collating regions, between which a transfer device or a merging feed is arranged, it has proven advantageous to use the receiving units twice or even multiple times in one circuit about the conveying track of the collating apparatus. In this case, a receiving unit receives a first part collection in a first collating region, transfers it in a transfer device following in the conveying direction or merges it with a further part collection in a merging feed following in the conveying direction. The receiving unit, now empty again, can receive a further part collection in the same circuit in a further collating region and can transfer or output it again in a following transfer device or a following merging feed.

As claimed in the present invention, the part collections can be merged singly or in the shingle stream with further part collections or printed products that include further part collections to form product collections.

As already addressed, by means of the new system and the new method it is made possible, using the same system with one collating apparatus and no additional expenditure, to produce complex products, the part collections of which run through different further processing processes. Each of the receiving units can be provided in a known manner in the collating regions with a part collection of pre-products and/or supplements. In this connection, consecutive receiving units can receive identical part collections or the receiving units are provided with products in an alternating manner by different supplying devices such that they transport different collections. Depending on the production plan and on the capacity of the following processing apparatuses and depending on the length of the transport paths between the following processing apparatuses, in this case, directly consecutive receiving units can be provided with different part collections, or in each case groups of a few to several dozen receiving units are provided in batch mode with a certain part collection and a following group receive another composition of pre-products from other supplying devices. By the apparatuses as claimed in the invention including at least one transfer device and at least one merging feed, it is made possible to allocate the part collections from each receiving unit to a certain transfer device or a certain merging feed and consequently to supply them to certain further processing or for the production of a certain product collection.

As claimed in further embodiments, the part collections which are allocated to a certain transfer device or a certain merging feed can be individualized even further. As each supplying device of the collating apparatus can be controlled individually, each part collection, which is collated in a certain receiving unit, can be collated from a desired combination of pre-products. The part collections can include from one single pre-product to a plurality of pre-products. In the active production, consequently, part collections which are allocated to the same transfer device or the same merging feed can be varied in their composition.

Thus, a first type of part collections, for example, can be supplied via a first transfer device to further processing where they are inserted into a main product, for example in the form of a main product. A second type of part collections can be supplied via a second transfer device to a merging feed including an insertion device in which the second part collection can be added into the product, in the meantime further processed to form a sewn and trimmed magazine, made up by main product and inserted first part collection in a further insertion operation. The part collection of the second order produced in this manner includes the main product with the first inserted part collection (in the form of the sewn and trimmed magazine) and the second part collection inserted into the magazine.

Such a part collection of the second order can also be produced by a collating operation where the magazine with the first inserted part collection comes to rest on or under the second part collection, or it can be produced by an insertion operation where the second part collection is inserted next to the magazine.

The part collection of the second order is then combined with a further part collection from the collating apparatus in a further merging feed to form a product stack or a finished product collection which now consists of a magazine (including the inserted and then sewn in first part collection) and two further part collections.

As claimed in the present invention, a first type of part collections can also be supplied via a first transfer device to further processing where they are inserted into a main product, for example in the form of a magazine, and a second type of part collections can be supplied via a second transfer device to a first merging feed in which they are added to the magazine which in the meantime has been further processed, for example addressed. The part collection of the second order produced in this manner includes the magazine with the first inserted part collection and the second part collection in a stack. Such a part collection of the second order can be deposited in a following second merging feed onto a third part collection such that a collection including three part collections and one magazine is created. The magazine preferably lies at the top of the product stack so that the addressing is not covered by the further part collections.

By deviating from the serial processing concept, the system as claimed in the invention and the method as claimed in the invention, by means of a collating apparatus which is given a central position in the finishing system, makes it possible to divide the stream of collated products into individual streams of part collections which are supplied via different transfer devices to different types of further processing in one or different further processing lines and via a merging feed are combined with at least one further part collection from the same collating apparatus to form a complex product stack.

The collating devices of the print finishing systems as claimed in the invention all enable return of incomplete part collections and completion of the same. This is made possible through product tracking over the entire apparatus. For each receiving unit the type and quantity of the products which are collated therein are determined by the control means. The control means determines in an advantageous manner the actual state of each clamp and additionally also knows the required state of the same such that a decision can be made as to which method steps are carried out. As the position of each receiving unit is known precisely at all times, not only is it possible to repair incomplete part collections with the missing pre-product or pre-products, but it is also possible to supply product collections from certain receiving units in a targeted manner to certain transfer devices or certain merging feeds.

BRIEF DESCRIPTION OF THE DRAWINGS

The invention is to be explained below by way of exemplary embodiments in conjunction with the drawings, in which, in detail.

DETAILED DESCRIPTION OF THE INVENTION

Figure 1:
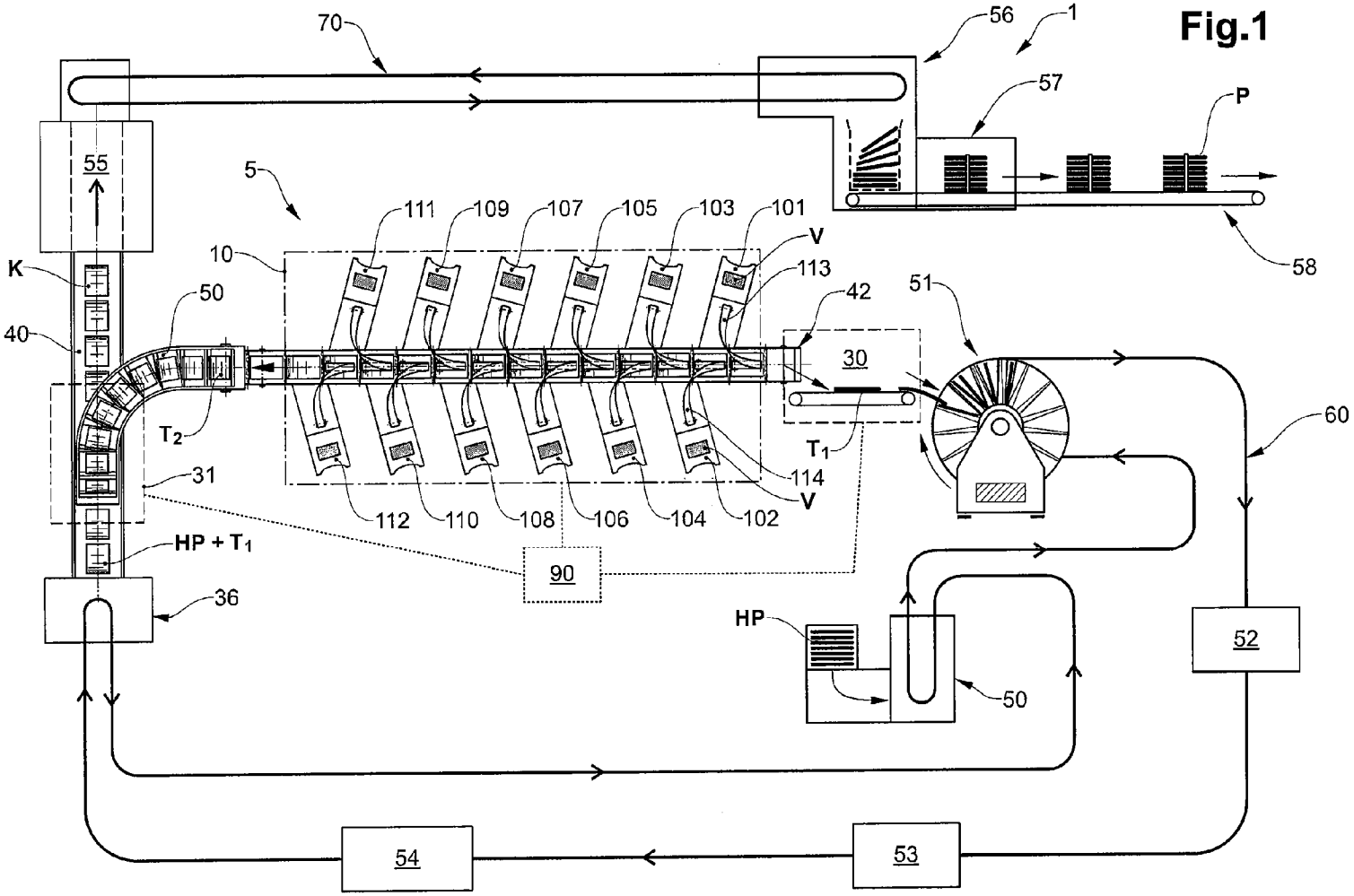
FIG. 1 shows a schematic general representation of an exemplary finishing system as claimed in a first embodiment having a collating apparatus with a collating region, said finishing system, having, in each case at opposite regions, transfer devices for the part collections which, in their turn, are part of merging feed devices.

FIG. 1 shows a schematic design of the print finishing system 1 as claimed in a first embodiment of the present invention. A collating apparatus 5 takes up a central position in said system 1. A total of twelve supplying devices 101-112 are arranged in each case in an alternating manner, on both sides of the conveying track in a collating region 10—indicated by the dot-dash rectangle in the figure. By means of the supplying devices 101-112 pre-products can be removed from a storage stack and supplied via a spiral track 113, 114 (looping) into the receiving units which are moved past. These types of supplying devices 101-112 are known as "JetFeeders" by the applicant.

Figure 2:
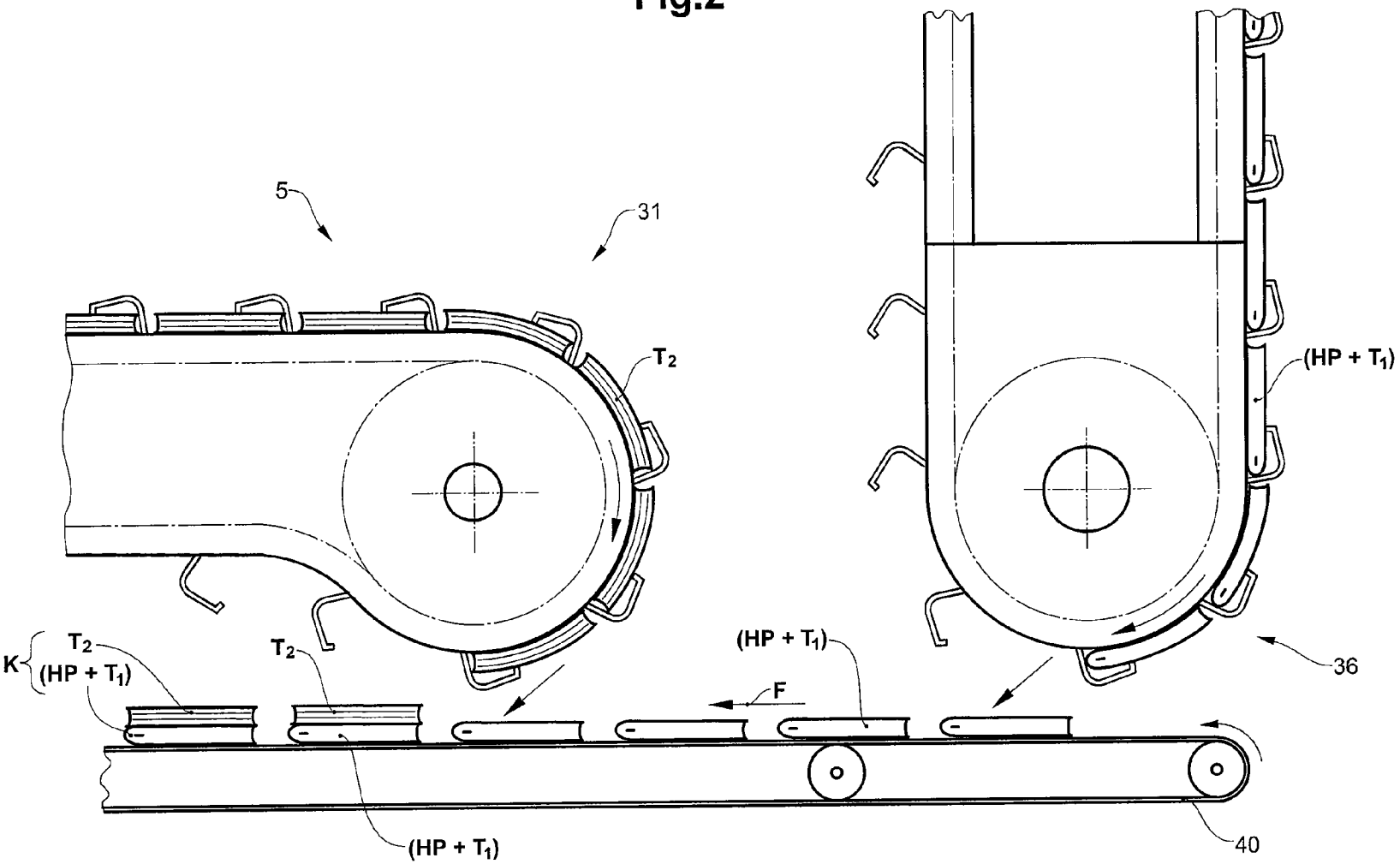
FIG. 2 shows a simplified representation of a detail of a merging feed unit.

When running through the collating region 10, pre-products, by forming a stack, can be supplied in succession into the receiving unit 50 (placed in, fed in or inserted). The pre-products are supplied via supplying devices, as are known by the applicant under the name of "JetFeeders". If the desired pre-products V are completely collated in the receiving units after running through the collating region 10, the first part collection T1 is present and is preferably held in a clamping manner in the receiving unit by means of a grab jaw (not shown). The closed grab jaws of the receiving units with the part collections T1 located therein are then transported via several curved track sections through a merging feed 31 and along a lower run to a transfer device 30. The first transfer device is situated in the guide region 42 and is only shown by way of a dot-dash box in FIG. 1 for reasons of clarity. In the example according to FIG. 1, the transfer device 30 shown includes a transport device which is shown in a simplified manner as a conveying belt which takes the part collections T1 from the receiving units and transports them for further processing in an insertion apparatus 51. In the insertion apparatus 51 the part collection T1 is inserted into a main product HP, which originates from a receiving unit 50, is supplied in a known manner to the insertion apparatus by way of a grab conveyor 60 and is conveyed through said insertion apparatus. The grab conveyor 60 transports the main product with the inserted part collection (HP+T1) to an output device 36. A sewing unit 52, a trimming drum 53 and an addressing unit 54, in which the main product with the inserted part collection (HP+T1) can be sewn, trimmed and addressed, are arranged along the transport section such that three further processing steps can be carried out along the finishing line shown. In the output device 36, the main products with the inserted part collections (HP+T1) are output onto a conveying belt 40 in succession and spaced apart from each other, as is shown in the detail enlargement according to FIG. 2. The main products with the inserted part collections (HP+T1) are transported spaced apart from each other in the conveying direction F to the merging feed 31, where a further part collection T2 from the collating apparatus 5, whilst retaining the precise spatial alignment of the individual products of the part collection T2 and of the main products with the inserted part collections (HP+T1), is placed in a controlled manner onto the main product such that a product collection K is formed.

From FIG. 1 it can be seen that the complex product collections K, produced in this manner, are guided on the conveying belt 40 through a coating station 55 in which they are heat-sealed in plastics, material film. A further grab conveyor 70 takes up the heat-sealed collections K and transports them to a destacking apparatus 56 with a binder 57 connected downstream in which from a predetermined quantity of collections K packages P are produced and supplied for removal and dispatch 58.

Figure 3:
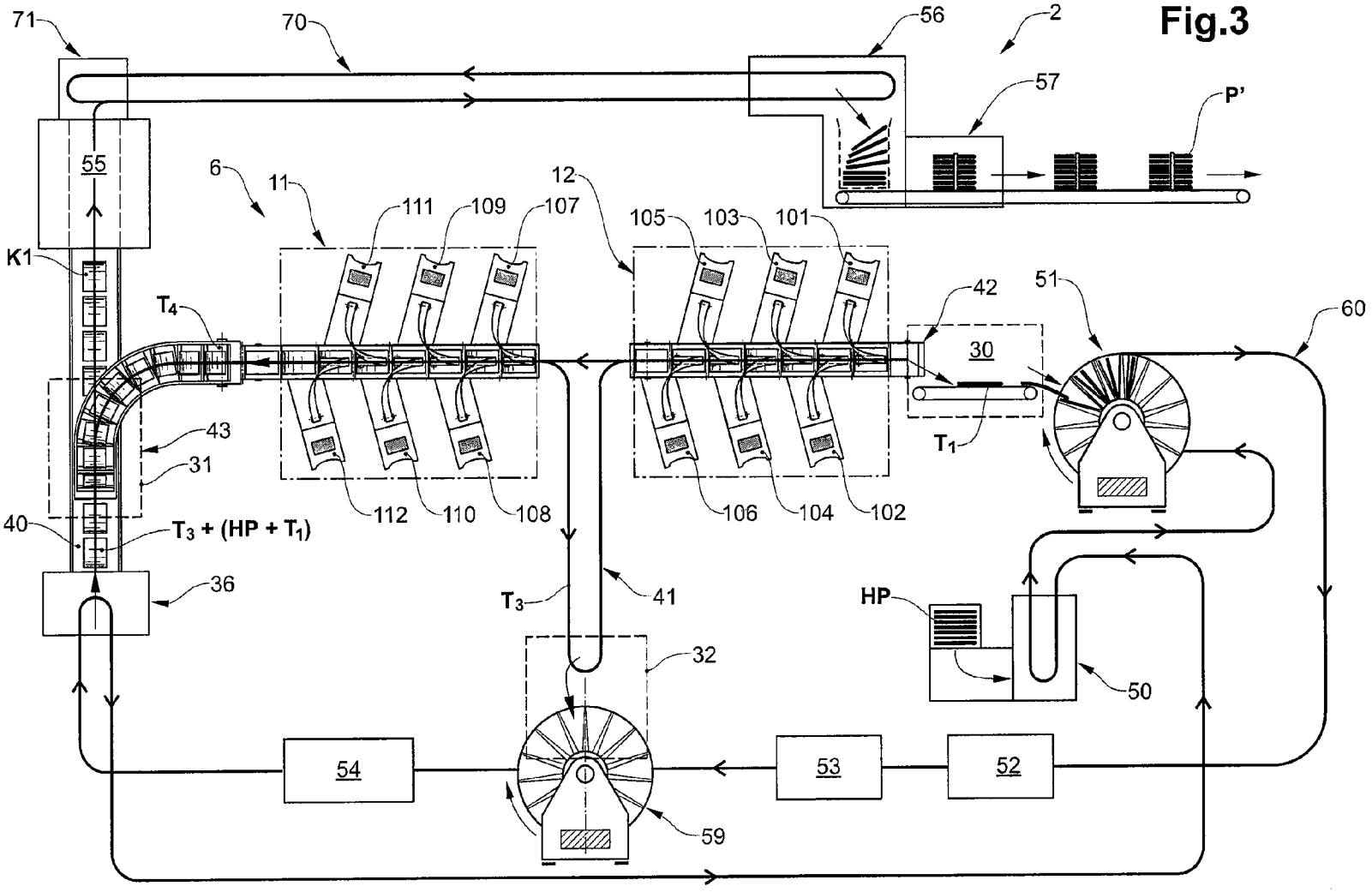
FIG. 3 shows a schematic general representation of a further finishing system as claimed in one embodiment of the invention having a collating apparatus with two collating regions, said finishing system, having, in each case at opposite regions and in a central region, a total of three transfer devices for the part collections which, in their turn, are part of merging feed devices.

FIG. 3 shows a print finishing system 2 according to a further embodiment of the present invention, where the collating apparatus 6 has two collating regions 11, 12. The conveying track between the two collating regions 11, 12 following each other in succession is laid-out forming an intermediate loop 41 and a merging feed 32 is arranged at the intermediate loop 41. Said merging feed 32, which includes a second transfer device—not shown—is only also indicated as a broken line box in FIG. 3. The transfer device is realized, for example, once again in the form of a conveying belt which takes the part collections T3 from the receiving units (not shown either) and transports them to the insertion apparatus 59. There the part collections T3 with the sewn and trimmed main products are merged with the inserted part collections T1 (marked in the figure by (HP+T1)). After the merging in the insertion apparatus 59, the part collections of the second order T3+(HP+T1) are transported for addressing 54. The addressed part collections of the second order T3+(HP+T1) are placed onto the conveying belt 40 in the output 36 by the grab conveyor 60 and are transported to the merging feed position in the merging feed 31. The merging feed is effected once again as described in the previous case in relation to FIG. 2. However, the merge-fed part collections are different from each other. The merging feed 31 is developed in such a manner that the part collections T4 are placed in a positionally precise manner onto the addressed part collections of the second order T3+(HP+T1) such that the collection K1 is produced. The merging feed of the part collections is effected in the region of a guide 43 of the collating apparatus 6, wherein the part collections to be merge-fed, more precisely the receiving units and the conveying belt, are aligned parallel or tangentially with respect to each other in the region of the merging feed. As a result, the stacking in layers in general and in particular the maintaining of the precise spatial alignment of the individual pre-product stack T4 and the controlled output thereof is made simpler. The collections K1 are once again coated 55 and are taken up by the grab conveyor 70 in the receiving unit 71, transported to the destacker 56, destacked and are strapped in the binder 57 to form packages P'.

If, as is shown in FIG. 3, no part product T1 is collated in the collating apparatus in the print finishing system 2, and in a corresponding manner no part product is output at the transfer device 30, the merge feed 32 can be operated as a transfer unit. For example, it is possible for a part product T3 to be inserted into a main product HP originating from receiving means 50, which has been conveyed through the insertion apparatus 51 without an insertion operation and without a sewing operation in the sewing unit 52, but has been trimmed in the trimming drum. Such an insertion now corresponds in definition to transferring and not to merge-feeding as the main product does not originate from the collating apparatus 6.

The print finishing systems 1, 2 according to FIGS. 1 and 3 differ essentially purely by the aforementioned features. This is also to be clarified in that the remaining system parts are provided with the same reference symbols. The print finishing system 2, however, allows for the production of substantially more complex products. As in the case of the system 1 previously described, a first part collection T1 is inserted 51 into a main product HP, is sewn 52 and trimmed 53. In the next processing step, the main product produced in this manner is guided with the inserted part collection (HP+T1) through a second insertion apparatus 59 in which a further part collection T3 is placed next to the main product with the inserted part collection (HP+T1). A main product HP with an inserted part collection T1 and a stack of further pre-products arranged next to it, the part collection T3, is now therefore conveyed in a clamp of the grab conveyor 60. Said product composition is characterized by T2+(HP+T1). It is addressed in an addressing unit 54 connected downstream and in the output device 36 is once again placed onto the conveying belt 40 and supplied to the merge feed 31. Here a part collection T4 from the receiving units of the collating apparatus 6 is placed onto the product composition T2+(HP+T1) such that a collection K1 is formed. Said product collection K1 includes a product stack from a part collection T2 located underneath on which lie a main product with the inserted part collection (HP+T1) and on top the further part collection T4. Said complex product collection K1 can once again be heat-sealed in film in the coating unit 55 connected downstream, transferred in an output 71 to a grab conveyor and strapped by means of destacking unit 56 and binder 57 to form packages containing the desired quantities.

The afore-described exemplary embodiments make clear what can be achieved as regards a high amount of spatial, as well as functional flexibility by the apparatus as claimed in the invention. The control means 90, which, in a predetermined manner, controls at least the supplying devices, the transfer device and the merging feed in such a way that in each case the desired part collections or printed products including a part collection are available at the merging feed 31, is indicated with the associated data lines only by a dotted line in FIG. 1.

The conveying directions F, more precisely the corresponding conveying means in the transfer device as claimed in the invention and the merging feeds in the region of the product transfer are preferably aligned parallel or tangentially with respect to each other. As a result, the product transfer in general and in particular the maintaining of the precise spatial alignment of the individual products and of the products in the stack and the controlled output thereof is made simpler.

Figure 4:
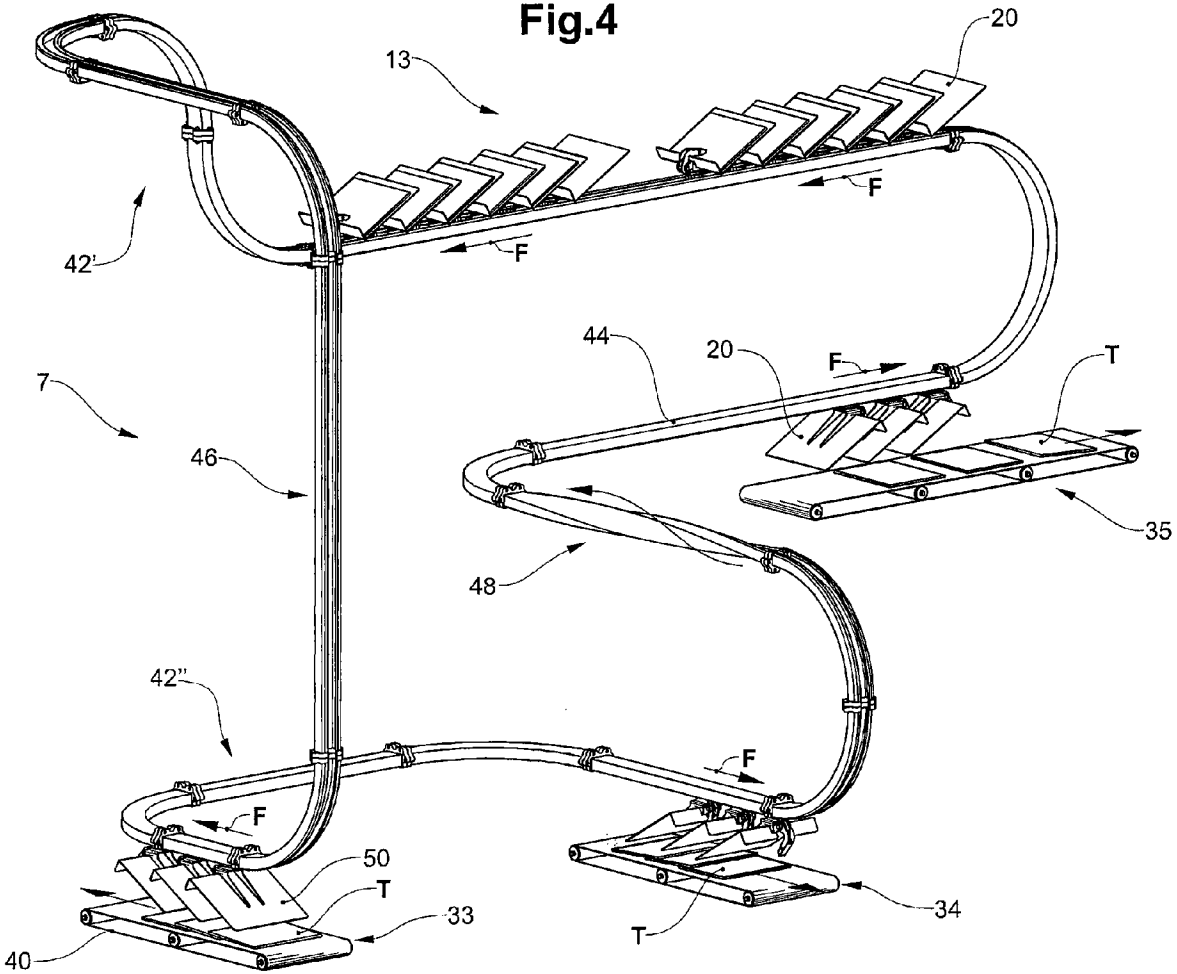
FIG. 4 shows a perspective view of a further exemplary embodiment of a collating apparatus where the conveying track runs in several horizontal levels and a collating region and three transfer devices are arranged in different levels and different directions.

In the collating apparatus 7 according to a further exemplary embodiment of the present invention shown in FIG. 4, the collating apparatus 7 includes a central collating region 13 to which, downstream in the direction F, a merging feed 33 and two transfer devices 34 and 35, arranged in the direction of circulation F of the conveying member after the merging feed 33, are connected. Of the merging feed 33 only a conveying belt 40' and the portions of the collating apparatus 7 with individual receiving units 50 are shown. It is clear from FIG. 4 that the two transfer devices 34, 35 and the merging feed are arranged on different levels and in different spatial directions. Without any great structural expense, the conveying track can be adapted to all local conditions via different guide regions 42', 42" and linear track sections 44, 46 arranged in between said regions. By means of spiral-shaped sections 48, the receiving units can be pivoted, even during conveying, about the longitudinal axis of the conveying track. The receiving units, directed upward prior to running through the section 48, are pivoted therein downward about 180° until they are located under the conveying track. As claimed in the invention, the use of spiral-shaped sections is not restricted to linear sections of the conveying track. They can also be arranged in guide regions such that the receiving units can be guided along complex, superposed, three-dimensional curves.

It is also clear from FIG. 4 that the part collections T produced by means of the systems as claimed in the invention can be output in the shingle stream (in the merging feed 33) or also singly (in the transfer devices 34, 35).

The part collections to be merge-fed can be merge-fed in a controlled manner in general by means of suitable merging feeds, that is therefore in the form of stacked shingle streams from part collections whilst maintaining the precise spatial alignment. Such a method of operation is advantageous when the product collections do not have to be present spaced apart from each other for a connecting coating operation, but when they just have to be freely accessible at a forward edge, for example, for transfer by a grab conveyor.

The apparatus as claimed in the invention and the method as claimed in the invention allow gaps to be generated in each case in a targeted manner in the product streams from product collections from the individual transfer devices, irrespective of whether they are supplied singly or in the shingle stream for further processing. Such gaps can be desired for product-engineering reasons, for example in order to relieve a following operation/apparatus in the further processing, for example a destacking apparatus for the production of packages with small quantities. Such a gap in a product stream can be generated, for example, in that in one collating region in which two types of part collections A and B in successive receiving units are collated as follows: A, B, A, B, B, B, A, B, A, B. By the fifth receiving unit not being provided with a collection of type A, but with a part collection of type B, no part collection is output from the fifth receiving unit when passing the transfer device for the output of the part collections of type A and a product gap (A, A, -, A, A; hereafter referred to as a gap) is generated in the output stream of the part products. In this way it can be achieved that, for example, a part collection of advertising supplements is not inserted into a certain main product, said individually advert-free main product however is then provided in the merging feed with a further part collection B, including an editorial magazine and a product supplement, as the product stream of the part collections B does not have a corresponding gap.

The same gap can be generated by the corresponding supplying devices not outputting the pre-products for the fifth receiving unit (A, B, A, B, -, B, A, B, A, B) such that once again a gap is formed at the third position in the output product stream of the type A part collections.

In the case of a batch-type production mode as claimed in the present invention, some dozen to some thousand identical part collections of the first type T1 are collated in a collating apparatus, as is sketched for example in FIG. 1, and are supplied via the first transfer device 30 for further processing. The size of the batch is essentially limited by the length of the transport path between the insertion apparatus 51 and the output device 36, more precisely by the number of clamps in the grab conveyor 60 along said section. If, for example, 500 clamps are situated along said section, the collating apparatus 5, by utilizing all the receiving units 50, can produce at least 500 part collections T1 and output them to the grab conveyor 60 before the first of the 500 part collections reach the output device 36 and then the merging feed 31. The collating of the part collections T2—once again utilizing all the receiving units 50—is not started until the complete batch of the type T1 is produced. As the path of the part collections T2 in the collating apparatus 5 from the collating region 10 to the merging feed 31 is comparatively short, the part collections T2 reach the merging feed in good time in order to be merged with the first part collections T1.

The size of the batches of part collections can be reduced in an arbitrary manner as far as down to the abovementioned sequence A, B, A, B, . . . where a batch of an individual product is formed. In the case of apparatuses with more than two transfer devices and/or merging feeds, in a corresponding manner more than two types of part collections can also be collated and processed in batches.

Figure 5:
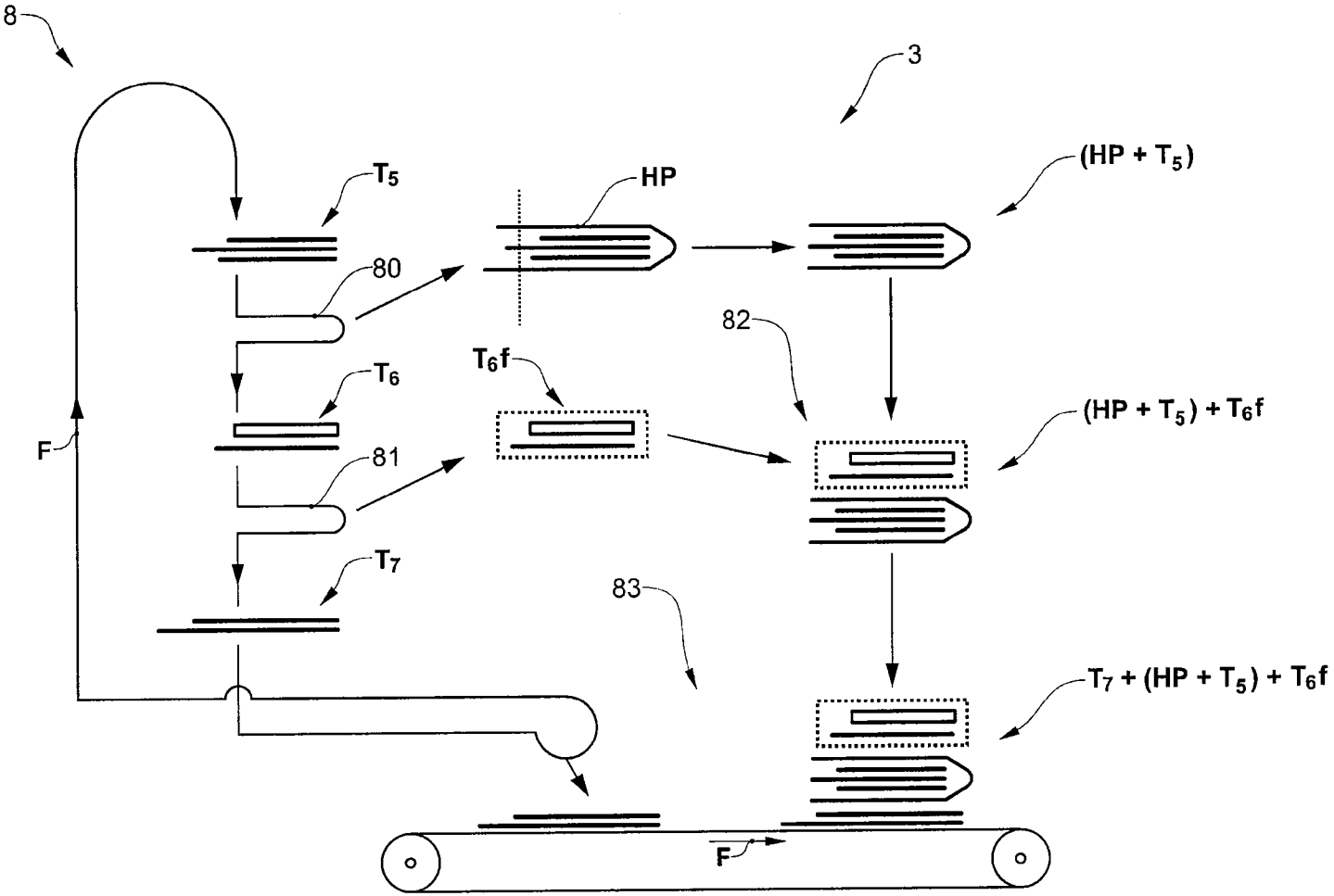
FIG. 5 shows a schematic representation of production steps for the production of a complex product collection.

FIG. 5 shows a strongly schematic representation of the production of a complex product collection as claimed in a further embodiment of the present invention in a print finishing system 3. Three different part collections T5, T6 and T7 are collated using the collating apparatus 8. The first part collection T5 is supplied by means of a first transfer device 80 for further processing where it is inserted into a main product HP and is trimmed at the edge indicated by the broken line). The correspondingly produced main product HP with the inserted part collection T5 is designated by (HP+T5). A second part collection T6 is supplied via a second transfer device 81 for further processing where it is heat-sealed in film (indicated by the dotted rectangle in FIG. 5 and given the reference T6*f*). In a first merging feed 82, the coated part collection T6*f* is placed onto the main product with the inserted part product 5 (HP+T5) such that a part collection of the second order (HP+T5)+T6*f* is formed. In the second merging feed 83, a part collection T7 from the collating apparatus 8 is then placed onto a belt conveyor and the previously formed part collection (HP+T5)+T6*f* is deposited onto said part collection T7. Using only one single collating apparatus 8, it is therefore possible as claimed in the present invention to produce extremely complex product collections T7+(HP+T5)+T6*f*, the part collections of which, where required, run through different further processing steps and are then merged together.

By way of the merging feed 82 of the exemplary embodiment of FIG. 5, it is clear to the expert that the merging feeds as claimed in the invention do not have to be arranged directly at the conveying track of the collating apparatus. As claimed in certain advantageous embodiments, they are arranged spaced from the conveying, track of the collating apparatus and are connected thereto via transport means, for example via conveying belts or grab transporters. The merging feeds can accordingly include not only transfer devices, by means of which only transferring takes place, but they can also include transfer devices in/or on which the part collections to be transferred are processed or further processed.

The invention claimed is:

1. A print finishing system (1, 2, 3) for collating and further processing flat pre-products (V), said print finishing system comprising:

a collating apparatus (5, 6, 7, 8) including a conveying track and a plurality of receiving units (50) arranged one behind the other in a direction of circulation on the conveying track in a closed circuit, wherein the plurality of receiving units (50) circulate on the conveying track to receive pre-products (V) to be collated, the collating apparatus (5, 6, 7, 8) further including at least one collating region (10, 11, 12, 13) including several supplying devices (101-112) arranged one behind the other in the direction of circulation, and from which pre-products (V) are output into the receiving units (50) moving past on the conveying track;

a transfer device (30, 34, 35, 80, 81) which transfers collated first part collections (T1, T5) from the receiving units (50) for further processing, the transfer device (30, 34, 35, 80, 81) arranged at least at one position (42) on the conveying track;

a merging feed device (31, 35, 82, 83), which transfers collated further part collections (T2, T4, T6, T7) from the receiving units (50) and merges the collated further part collections (T2, T4, T6, T7) with the first part collections (T1, T5) or printed products that include the first part collection to form collections (K, K1), the merging feed device (31, 35, 82, 83) arranged at least at one further position (42", 43) on the conveying track or at a spacing therefrom; and a conveying device independent of both the receiving units (50) and the conveying track, and which transfers the collated first part collections (T1, T5) from the further processing, and upon which the merging feed device (31, 35, 82, 83) merges the collated further part collections (T2, T4, T6, T7) with the first part collections (T1, T5) or the printed products that include the first part collection (T1, T5).

2. The print finishing system (2, 3) as claimed in claim 1, further comprising at least one further transfer device and/or at least one further merging feed (32, 82) arranged at least at one further position of the conveying belt of the collating apparatus (5, 6, 7, 8).

3. The print finishing system (1, 2, 3) as claimed in claim 1, further comprising a control means (90) which, in a predetermined manner, controls the supplying devices (101-112), the transfer devices (30, 34, 35, 80, 81) and the at least one merging feed (31, 32, 33, 82, 83) so desired part collections or the printed products that include the desired part collections are available at the at least one merging feed (31, 32, 33, 82, 83).

4. The print finishing system (1, 2, 3) as claimed in claim 3, wherein the control means (90), in a predetermined manner, controls the supplying devices (101-112), the transfer devices (30, 34, 35, 80, 81) and the at least one merging feed (31, 32, 33, 82, 83) so that part collections (T2, T4, T6, T7) from the receiving units (50) are merged with the first part collections (T1, T5) or with printed products that include the first part collection in the at least one merging feed to form collections (K) according to a higher-ranking production plan.

5. The print finishing system (1, 2) as claimed in claim 3, wherein the control means (90) allocate the pre-products of a certain supplying device (101-112) or of a group of supplying devices (101-112) to a certain transfer device or a certain merging feed.

6. The print finishing system (2, 3) as claimed in claim 1, wherein the first part collections (T1, T5) or the printed products that include the first part collection (T1, T5) are output onto the conveyor device and then the merging feed device places the collated further part collections (T2, T4, T6, T7) onto the first part collections (T1, T5) or he printed products that include the first part collection (T1, T5).

7. The print finishing system (2, 3) as claimed in claim 1, wherein the conveying device is disposed beneath the merging feed device (31) to receive the collated further part collections (T2, T4, T6, T7).

8. The print finishing system (2, 3) as claimed in claim 1, further comprising an output device disposed between the further processing and the conveying device, and which transfers the collated first part collections (T1, T5) or the printed products that include the first part collection (T1, T5) from the further processing to the conveying device.

9. The print finishing system (2, 3) as claimed in claim 8, wherein the conveying device is disposed beneath the output device (31) to receive the first part collections (T1, T5) or the printed products that include the first part collection (T1, T5).

10. The print finishing system (2, 3) as claimed in claim 9, wherein the output device is disposed in combination with the conveying device upstream from the merging feed device.

11. The print finishing system (2, 3) as claimed in claim 10, wherein the conveying device is disposed beneath the merging feed device (31) to receive the collated further part collections (T2, T4, T6, T7), the merging feed device includes a plurality of clamps that each releasably secure one of the collated further part collections (T2, T4, T6, T7), and the output device includes a plurality of clamps that each releasably secure one of the collated first part collections (T1, T5) or one of the printed products that include the first part collection (T1, T5).

12. The print finishing system (2, 3) as claimed in claim 1, wherein the conveying device comprises a conveying belt (40).

13. The print finishing system (2, 3) as claimed in claim 12, wherein the conveying belt (40) is disposed beneath the merging feed device (31) to receive the collated further part collections (T2, T4, T6, T7).

14. A method for the collating and further processing of flat pre-products (V), said method including the following steps:

collating a first part collection (T1, T5) of pre-products from a certain supplying device (101-112) or a group of supplying devices (101-112) in at least one first receiving unit (50) on a conveying track;

collating a further part collection (T2, T3, T4, T6, T7) of pre-products (V) from a certain supplying device (101-112) or a group of supplying devices (101-112) in at least one subsequent receiving unit (50) on the conveying track;

transferring the first part collection (T1, T5) of pre-products by means of a certain transfer device (30, 80) to certain further processing;

transferring at least one further part collection (T2, T3, T4, T5, T6, T7) of pre-products by means of a further transfer device; and collating the first part collection (T1, T5) or a printed product produced by using the first part collection (T1) and at least one further part collection (T2, T4, T7) on a conveying device to form a collection (K, K1), wherein the conveying device is independent of the at least one first receiving unit (50), the at least one subsequent receiving unit (50), and the conveying track; and conveying the collection (K, K1) with the conveying device.

15. The method as claimed in claim 14, wherein in at least one further merge-feeding step at least one further part collection (T3, T6, T7) or one further printed product produced by using the further part collection is added to form a part collection (T1, T5) or a higher order part collection produced by using the first part collection (T1, T5) and at least one further part collection (T3, T6) is added.

16. The method as claimed in claim 14, wherein in at least one further merge-feeding step at least one further part collection from the collating apparatus is supplied for further processing.

17. The method as claimed in claim 14, wherein a receiving unit (50) receives a part collection in a collating region (11) in one circuit about the conveying track of the collating apparatus (6), outputs it in a transfer device following in the conveying direction or in a merging feed following in the conveying direction and in the same circuit in a further collating region (11) receives a further part collection and outputs it in a following transfer device or a following merging feed.

18. The method as claimed in claim 14, wherein the merge feeding of the part collections or of the printed products that include the part collections is effected by means of insertion next to each other or insertion into each other, stacking in layers, folding one over another and/or placing side by side.

19. The method as claimed in claim 14, wherein a first (T1, T5) and at least one further part collection (T2, T3, T4, T6, T7) are collated in an alternating manner or in batches in subsequent receiving units (50).

20. The method as claimed in claim 14, wherein the part collections are collated singly or in the shingle stream to form product collections.

* * * * *